US010385618B2

(12) United States Patent
Van Dyk

(10) Patent No.: US 10,385,618 B2
(45) Date of Patent: Aug. 20, 2019

(54) TUNNELLING MACHINE

(71) Applicant: Andre Van Dyk, Wierda Park (ZA)

(72) Inventor: Andre Van Dyk, Wierda Park (ZA)

( * ) Notice: Subject to any disclaimer, the term of this patent is extended or adjusted under 35 U.S.C. 154(b) by 0 days.

(21) Appl. No.: 15/748,129

(22) PCT Filed: Jul. 27, 2016

(86) PCT No.: PCT/ZA2016/050027
§ 371 (c)(1),
(2) Date: Jan. 26, 2018

(87) PCT Pub. No.: WO2017/020050
PCT Pub. Date: Feb. 2, 2017

(65) Prior Publication Data

US 2018/0216406 A1 Aug. 2, 2018

(30) Foreign Application Priority Data

Jul. 28, 2015 (ZA) ..... 2015/05411

(51) Int. Cl.
*E21B 7/02* (2006.01)
*E21D 9/00* (2006.01)
(Continued)

(52) U.S. Cl.
CPC ..... *E21B 7/025* (2013.01); *E21D 9/006* (2013.01); *E21D 11/152* (2013.01); *E21D 11/403* (2013.01); *F42D 3/04* (2013.01)

(58) Field of Classification Search
CPC ..... E21B 7/025; E21B 7/007; E21D 9/006; E21D 11/152; E21D 11/403; E21D 11/40; E21D 11/406
See application file for complete search history.

(56) References Cited

U.S. PATENT DOCUMENTS 5,083,550 A * 1/1992 Krauss ..... A61B 17/2251 600/427
5,098,163 A * 3/1992 Young, III ..... E21C 37/14 299/13

(Continued)

*Primary Examiner* — Carib A Oquendo
(74) *Attorney, Agent, or Firm* — Steven M. Shape; Dennemeyer & Associates, LLC

(57) ABSTRACT

The invention provides a machine for tunnelling in rock. The machine includes a pilot drill assembly for drilling a series of interfering parallel holes or a pilot hole into and generally perpendicular into a rock face and a blast hole drill assembly for drilling a series of blasting holes around the pilot hole or previous blast hole. The machine further includes a charge handling and loading assembly for loading the first series of holes with propellant charges and an ignitor system for igniting the charges. Included further is a rock clearing means for removing the blast rock from the blast face and a rock pick for clearing and picking the floor, roof or walls to provide access for the machine into the tunnel and a mobility assembly for moving the machine forward. Also included is a control console provided with control means for controlling the pilot drill assembly, blast hole drill assembly, charge handling and loading assembly, ignitor system, rock clearing means, the rock pick, a measure system for gas detection and management, a rock stress measure system and recording system.

12 Claims, 19 Drawing Sheets

(51) Int. Cl.

| | |
|---|---|
| ***E21D 11/15*** | (2006.01) |
| ***E21D 11/40*** | (2006.01) |
| ***F42D 3/04*** | (2006.01) |

(56) References Cited

U.S. PATENT DOCUMENTS

| | | | | |
|---|---|---|---|---|
| 5,816,750 | A * | 10/1998 | Steffenino | E21C 27/24<br>405/302.3 |
| 2010/0270076 | A1 * | 10/2010 | Ahola | E21B 7/025<br>175/2 |

* cited by examiner

TUNNELLING MACHINE

TECHNICAL FIELD OF THE INVENTION

This invention relates to a machine for tunnelling in rock.

BACKGROUND OF THE INVENTION

The inventor is aware of the use of high explosives to blast break rock to tunnel into rock. Although this is a well-established method for forming tunnels in rock, it suffers from a number of disadvantages and limitations.

Traditional explosives atomise, the rock and ore, in an area with an approximate diameter of up to 100 mm, around and in the vicinity of the drilled hole, from the explosives, including ore such as gold, and create large volumes of toxic dust. Ore from the dust is lost and the dust needs to be managed, at great cost, for safety reasons. Using high explosives requires (in some cases) the entire mine to be evacuated or partly evacuated, leading to down time. Due to the shock waves caused by high explosives other parts of the mine may be caved in or destabilized contributing to the danger of an already a hazardous working environment. In addition, the highly concentrated ore reefs or veins are blown up together with rock, which dilute the ore extensively. Tunnelling methods using traditional explosives can, for obvious reasons, not be continuous.

The inventor is also the inventor of a tunnelling method, which use a propellant base cartridge, rather than an explosive. This method includes the steps of drilling a series of interfering parallel holes or a pilot hole into and generally perpendicular into a rock face, drilling a first series of blasting holes around the pilot hole, loading the first series of holes with propellant charges, igniting the charges, and repeating the process for further series of blasting holes until the diameter of the tunnel is reached. The inventor believes that this method lends itself to automation and a machine for continuous tunnelling at high speeds.

It is an object of the invention to provide a machine for tunnelling in rock, which is, semi-or fully automated, continuous, fast and safer and more controlled than traditional tunnelling methods and which does not suffer from the disadvantages of using high explosives.

DESCRIPTION OF THE INVENTION

According to the invention there is provided a machine for tunnelling in rock, which machine includes:

a pilot drill assembly for drilling a series of interfering parallel holes or a pilot hole into and generally perpendicular into a rock face;

a blast hole drill assembly for drilling a series of blasting holes around the pilot hole or previous blast hole;

a charge handling and loading assembly for loading the first series of holes with propellant charges;

an ignitor system for igniting the charges;

a rock clearing means for removing the blast rock from the blast face;

a rock pick for clearing and picking the floor, roof or walls to provide access for the machine into the tunnel;

a mobility assembly for moving the machine forward; and a control console provided with control means for controlling the pilot drill assembly, blast hole drill assembly, charge handling and loading assembly, ignitor system, rock clearing means, and the rock pick.

The control console may preferably be remote for operating the machine from a remote location.

A gas detection sensor system may form part of the control system. This system will detect and measure the concentrations of methane gases and will stop any actions of the machine to prevent accidental ignition of the gas. Gas ignition prevention actions will be done before any drilling or blasting continues. This is done by purging the area with clean air to dilute the methane concentration to below the critical ignition mix.

A rock stress measuring system may be included to measure the stresses in the surrounding rock continuously.

The dimensions of the tunnel will be recorded as part of the sensor system. All the results will be fed to the control system and will form part of the mine planning system The machine may also include a mesh production assembly for producing a wire mesh lining for progressively lining the walls and roof of the tunnel. The mesh production assembly, includes a set of longitudinal wire spindles and a set of lateral wire spindles or spindle. The longitudinal wires are fed out and over forming wheels arranged along the shape of the tunnel. The lateral wires are drawn by means of directional guides and feeding wheels transverse and underneath the longitudinal wires and urged and welded to the underside of the longitudinal wires by means of a set of welding rams. Welding operations will be done under a water spray to prevent accidental ignition of methane gas mixtures that might be in the vicinity.

The rock clearing means may include a lower and forward extending pair of bucket type conveyors arranged on arms in a V-formation for drawing in any rocks on the floor of the tunnel in front of the machine. The arms may pivot in a horizontal plane allowing each to sweep in a lateral arc. The conveyors may also be configured to have a forward and backward movement. The rock clearing means further includes a conveyor belt to convey the rocks underneath the machine and onto a further conveyor system to move the rock out of the tunnel.

The machine may also be provided with a dust and smoke suppression system, typically a suction means for sucking in dusty air and a filter system.

The charge handling and loading assembly may include a main charge storage container for storage of rock breaking cartridges and a secondary loader magazine for housing the number of cartridges required for a blasting cycle. A charge conveyor connects the main charge storage container with the loader magazine. A reciprocal ram transfers one cartridge at a time from underneath the magazine into a drilled hole. In the case of a pair or set of drills, the reciprocal rams are spaced the same distance as the pair or set of drills.

The igniter of the igniter system is located at the end of the reciprocal ram, which ignites the charge as it is inserted at the required depth.

The blast hole drill assembly for drilling a series of blasting holes may include and be arranged on a hydraulic arm configured to move in any one or more of a x,y or z axis. It may further include two or more pairs of rock drills arranged on a rotatable track, and the pairs of drills are movable along the track. The blast hole drilling assembly may also be used to drill holes for roof anchors as required.

The pilot drill assembly may be arranged on its own hydraulic arm configured to move in any one or more of a x,y or z axis. The pilot drill assembly arm may also carry the rock pick for clearing and picking the floor, roof or walls.

The mobility assembly for moving the machine forward and backward may comprise a set of continuous belt tracks. In the case of a stope mining machine, the mobility assembly may also include a set of transverse tracks, which is configured to be lifted, when not in use.

In use, the remote operator will drill a pilot hole into and generally perpendicular into a rock face followed by a series of blasting holes around the pilot hole. The next series of holes will be drilled. While the next series of holes are being drilled, using the charge handling and loading assembly the operator will load the first series of holes with propellant based charges, which is ignited as soon as the charging is complete. As the rocks are being formed from the blasting, the rock clearing means removes the blast rock from the blast face. If needed a rock pick for clearing and picking the floor, roof or walls can be used to provide access for the machine into the tunnel. As the tunnel is formed, the machine is moved forward by means of a mobility assembly.

Typically, the interfering holes or pilot hole will create a free face into the rock face and need to be as large as possible. Ideally the holes will be a minimum of 3 m deep if the blast holes are 1.2 m. The pilot hole must be deeper than the blasting hole to de stress the rock face. A hole of typical diameter of 100 mm or larger can be used as the pilot hole. A series of smaller holes, drilled underneath each other, to form a "cut" can also be used as a pilot hole.

A first series of blasting holes to create a first cut may be drilled around the pilot hole. The blasting holes, which is the primary breaking holes may be drilled at specific distances from the pilot hole. The distance between these holes and the pilot hole may be such that the maximum breakage into the pilot hole will be achieved. Deeper than 1.2 m holes can be drilled but the placing and spacing of the cartridges in the blasting hole will then be controlled. Two or more spaced cartridges may be inserted into the hole. The cartridges may vary in the carried weight of propellant, the largest cartridge normally being the deepest.

Loading of the primary breaking cartridges may be arranged to have a breaking cartridge of minimum load of 180 gram in the deepest end of the hole. The hole may then be filled with an aggregate of 6-8 mm particle size to approximate 60%-70% of the hole depth. A front break cartridge of not less than 100 gram load may be loaded in the hole and the hole may be filled with the stemming material to approximate 100-75 mm from the brim. A stemming plug may be placed in the hole to block the movement of the stemming material and to give the cartridges the necessary time to fully ignite and to build up pressure.

Typically, the track width is about 2500 mm and the weight of the machine between 20 and 25 tons. The drill positioning will be pre-programmed depending on the type of rock. Power will be supplied by means of an electrical and water supply umbilical. The charge capacity will be sufficient for about 25 m and the wire mesh capacity sufficient for about 125 m. It is expected to tunnel at a minimum rate of about 5 m per hour with the machine. Higher rates can be achieved when the operation is fully optimised.

DETAILED DESCRIPTION OF THE INVENTION

The invention is further described by way of example with reference to the accompanying drawings.

Figure 1:
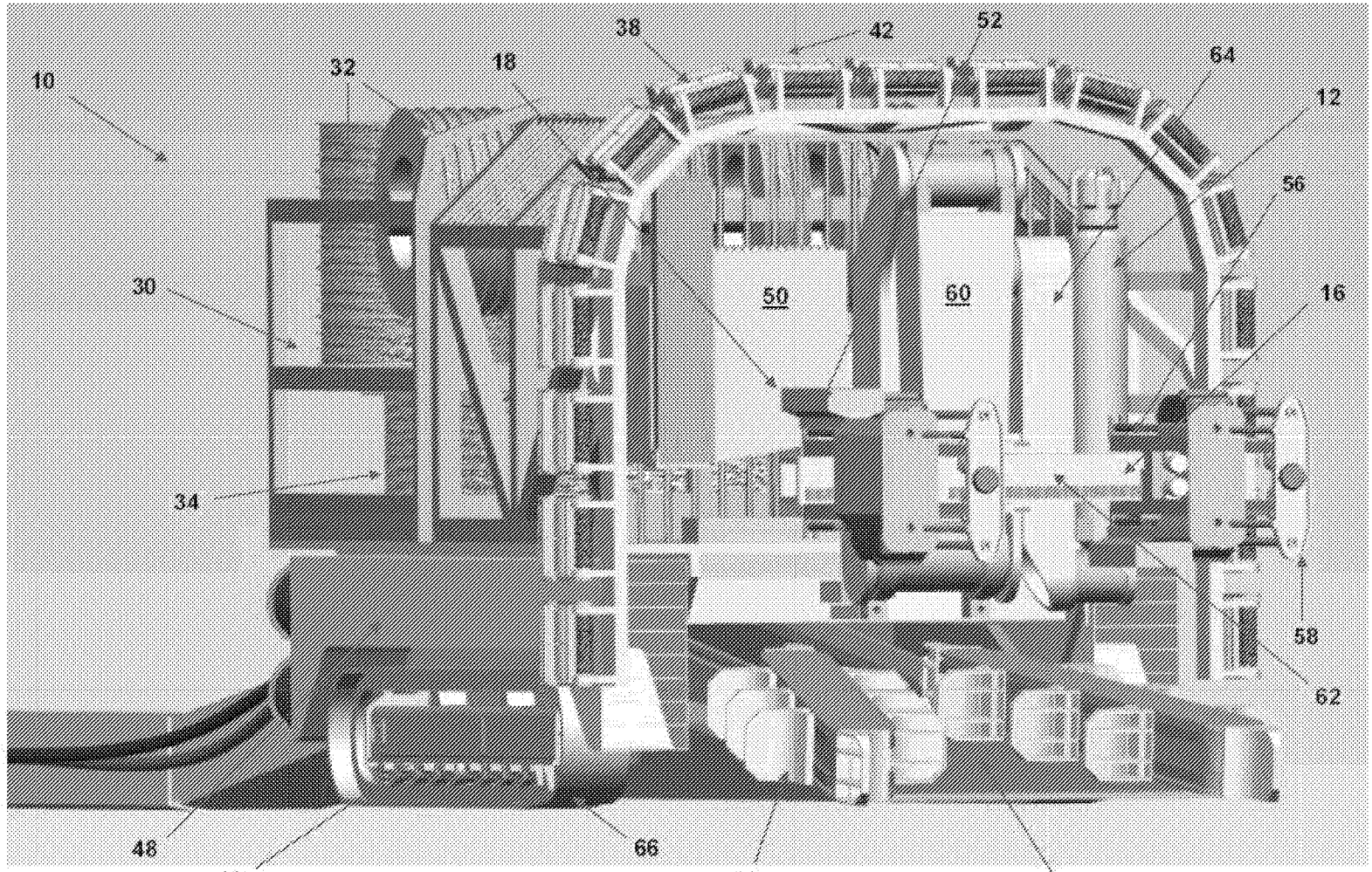
FIG. 1 shows a front side perspective view of a machine for tunnelling in rock, in accordance with the invention.
Figure 2:
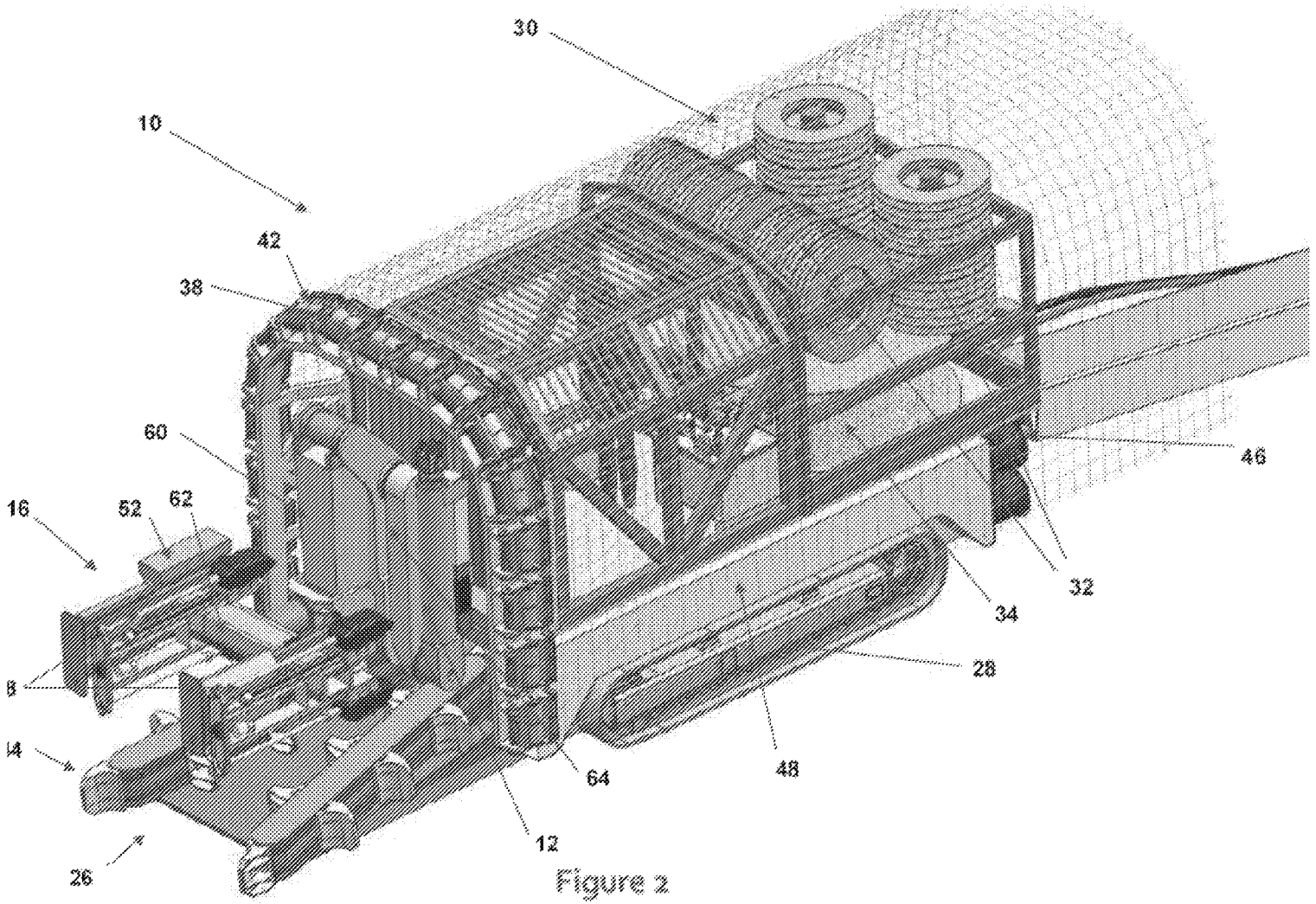
FIG. 2 shows a front top perspective view of the machine for tunnelling in rock.
Figure 3:
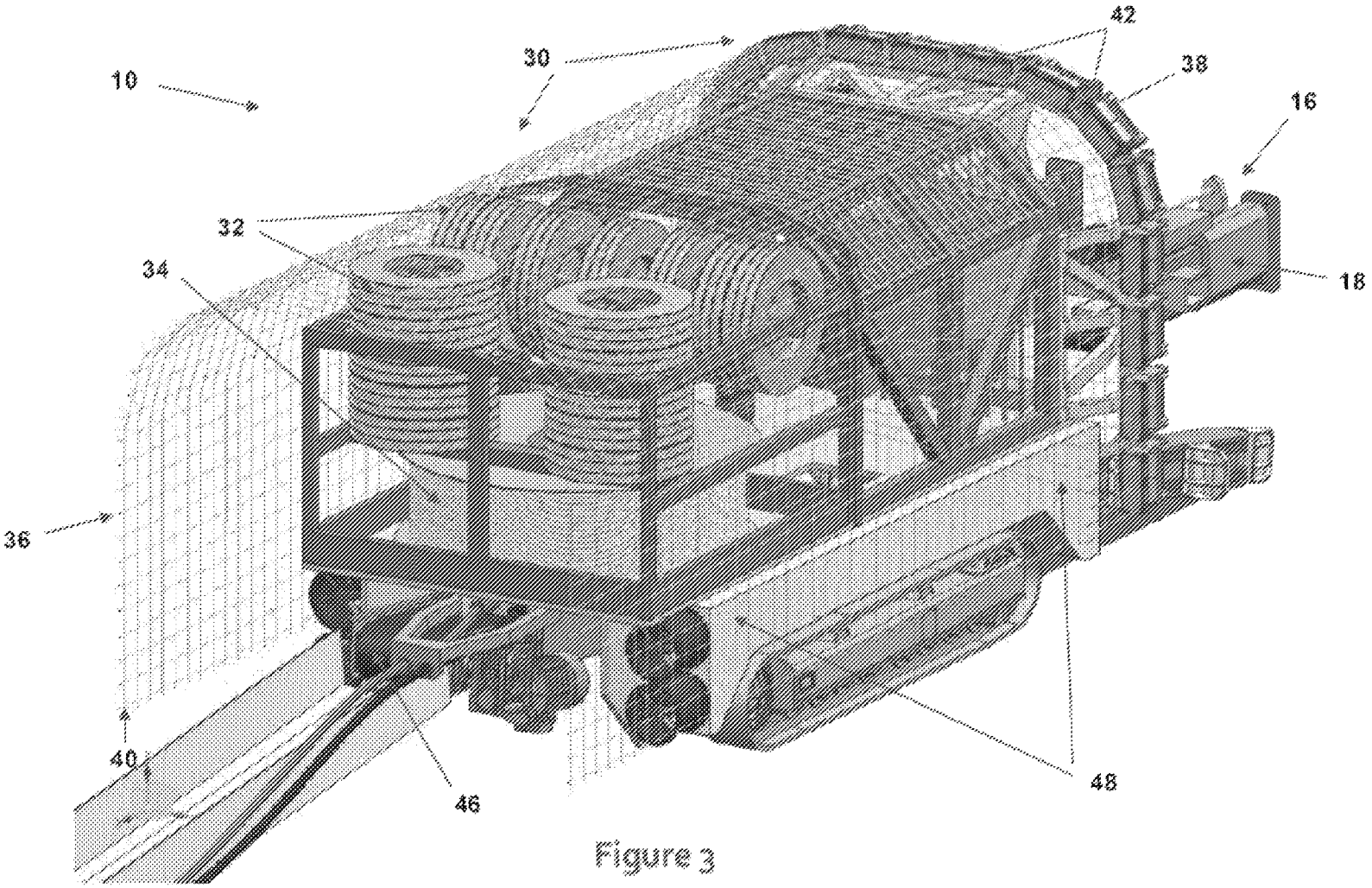
FIG. 3 shows a back side perspective view of the machine for tunnelling in rock.
Figure 4:
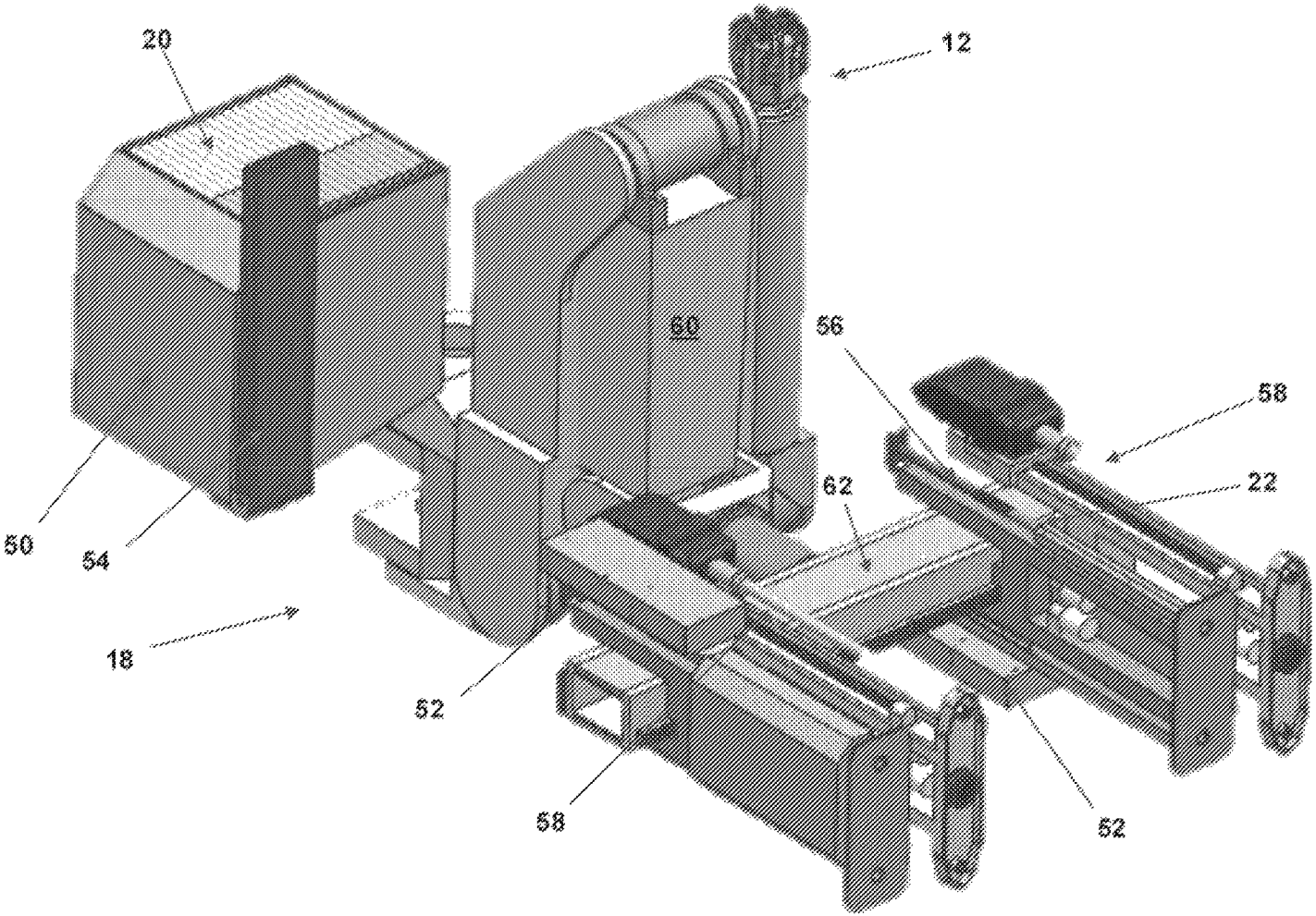
FIG. 4 shows a top perspective of drilling and charging systems of the machine for tunnelling in rock.
Figure 5:
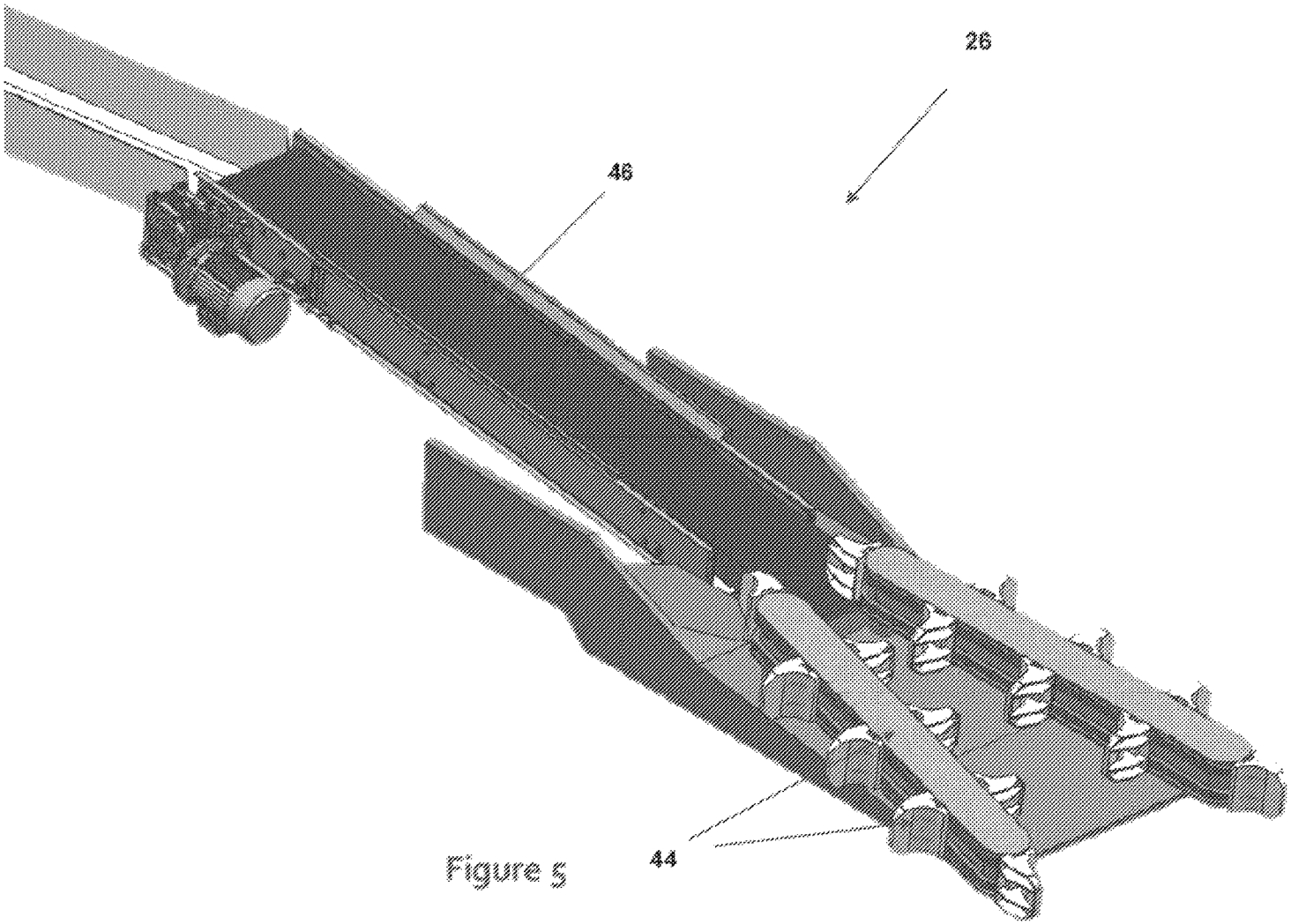
FIG. 5 shows a top perspective of the rock clearing means of the machine for tunnelling in rock.
Figure 6:
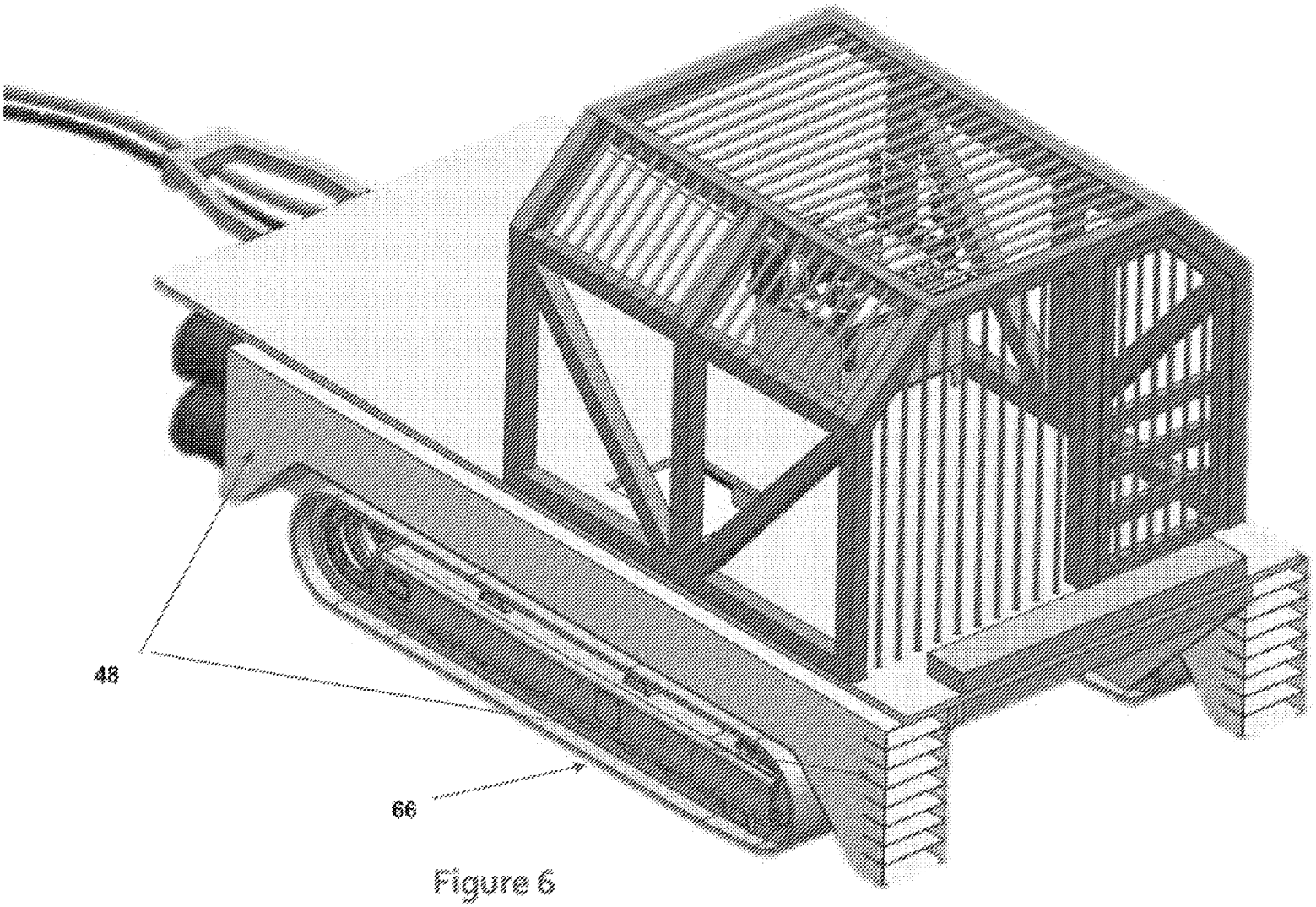
FIG. 6 shows a top perspective of the mobility assembly of the machine for tunnelling in rock.
Figure 7:
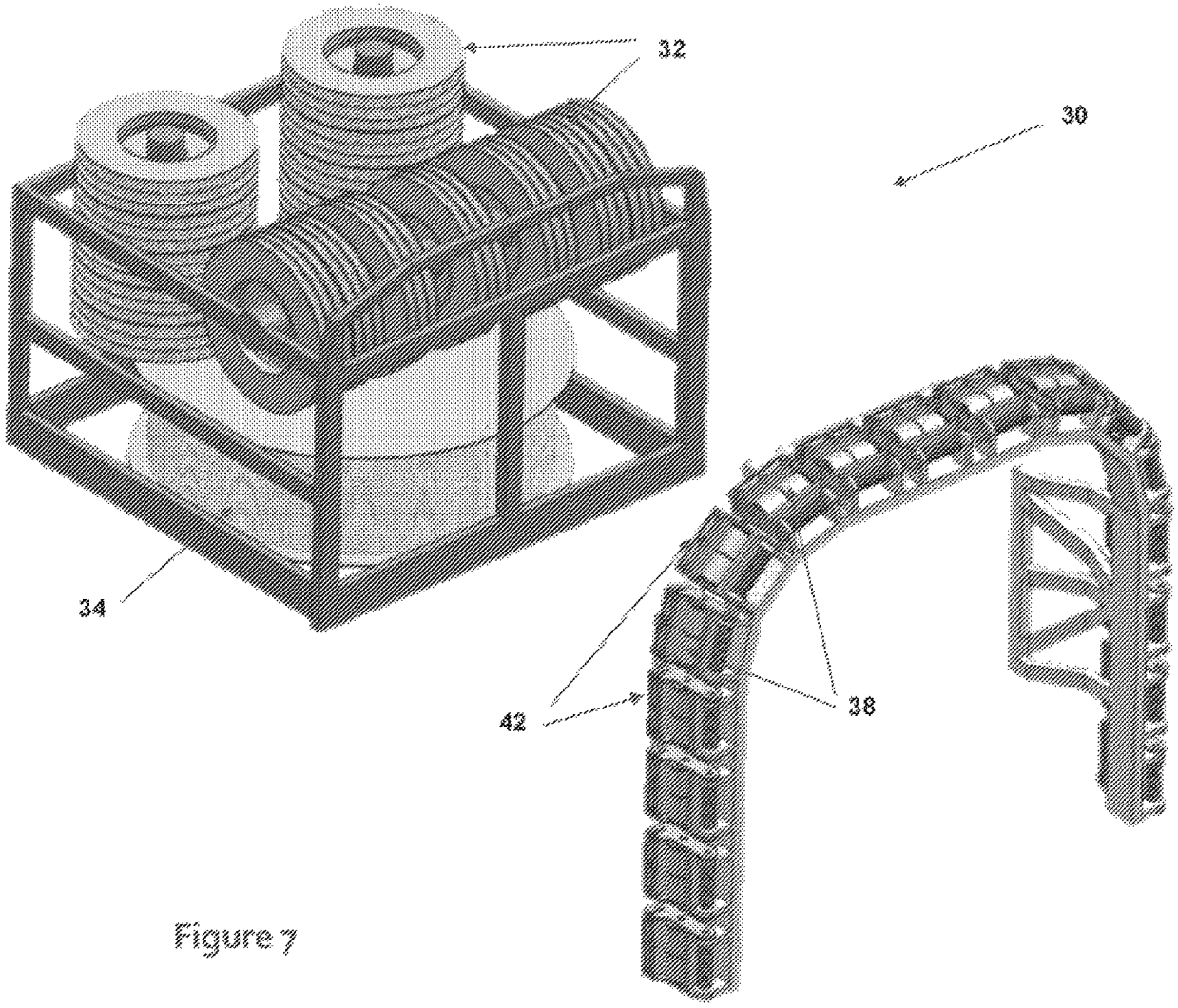
FIG. 7 shows a top perspective of the wire mesh production assembly of the machine for tunnelling in rock.
Figure 8:
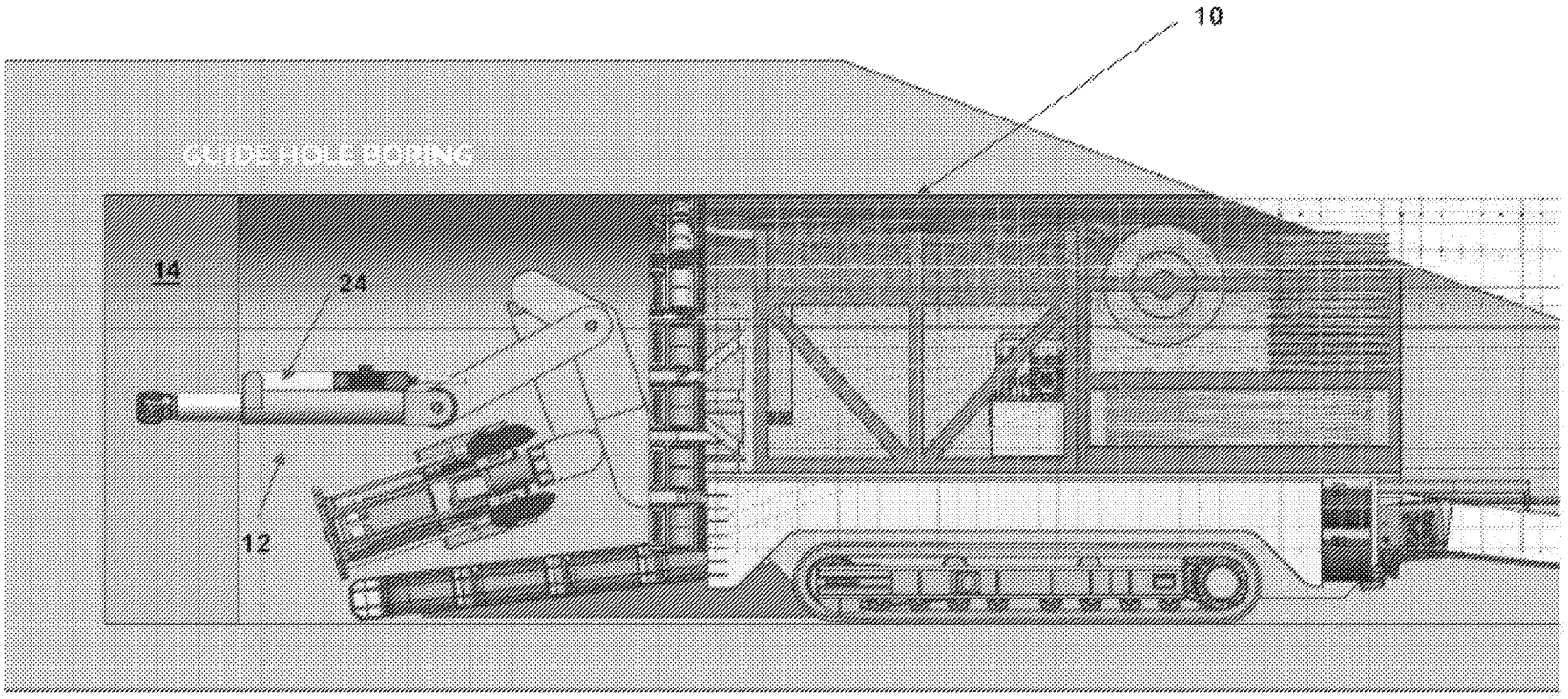
FIG. 8 shows a side view of the machine for tunnelling in rock drilling a pilot hole.
Figure 9:
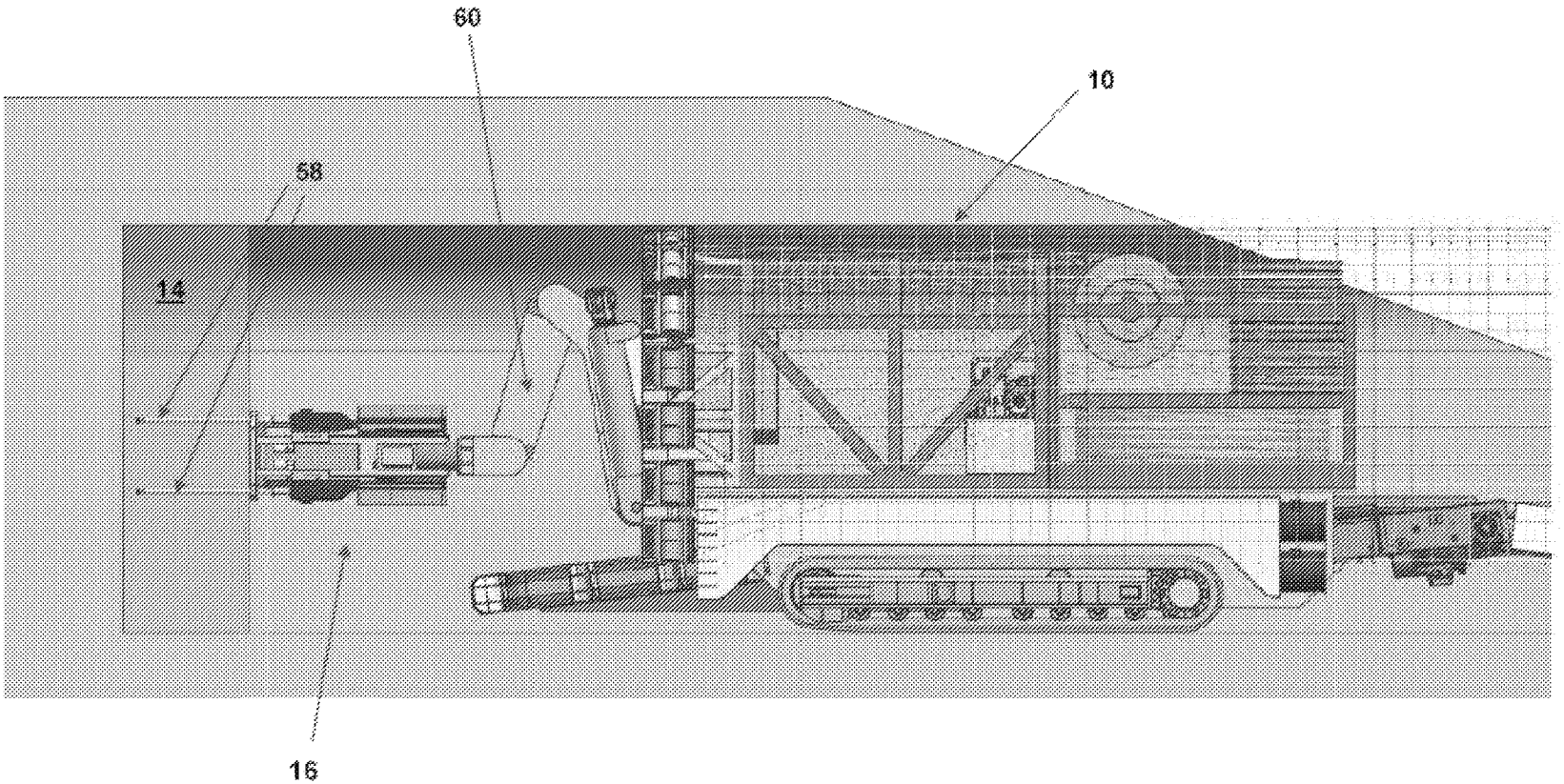
FIG. 9 shows a side view of the machine drilling blast holes.
Figure 10:
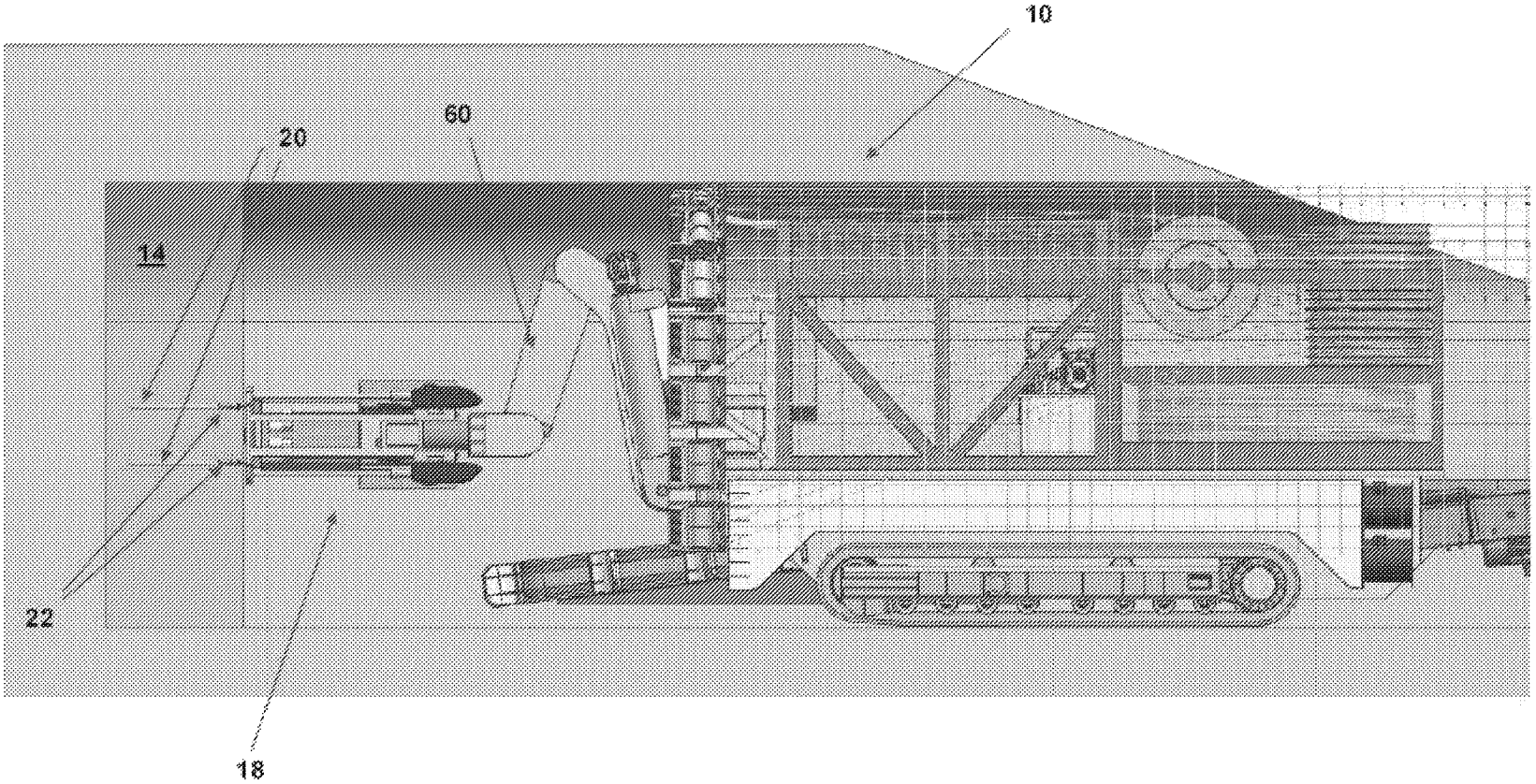
FIG. 10 shows a side view of the machine charging the blast holes.
Figure 11:
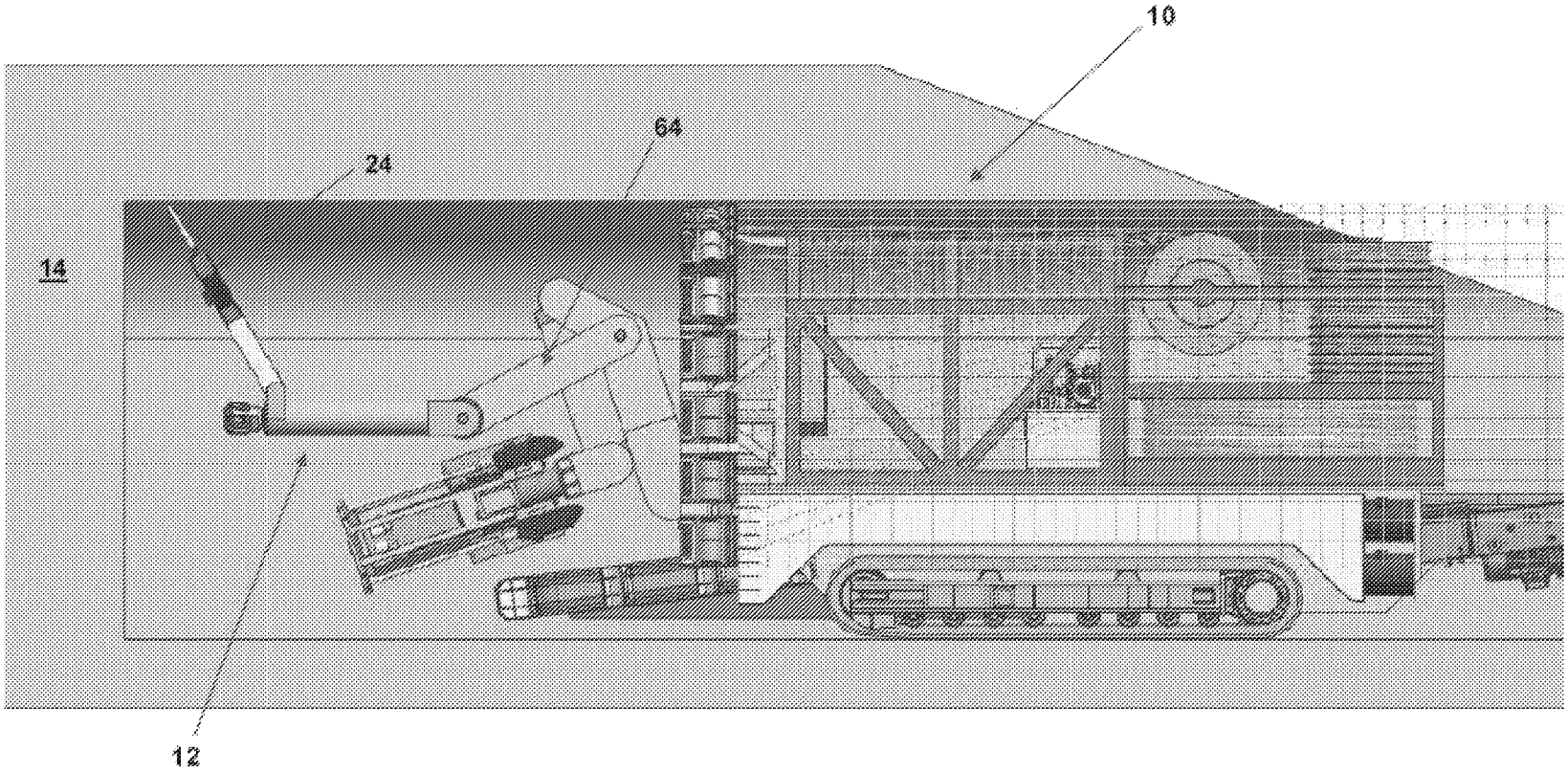
FIG. 11 shows a side view of the machine picking the roof of the tunnel.
Figure 12:
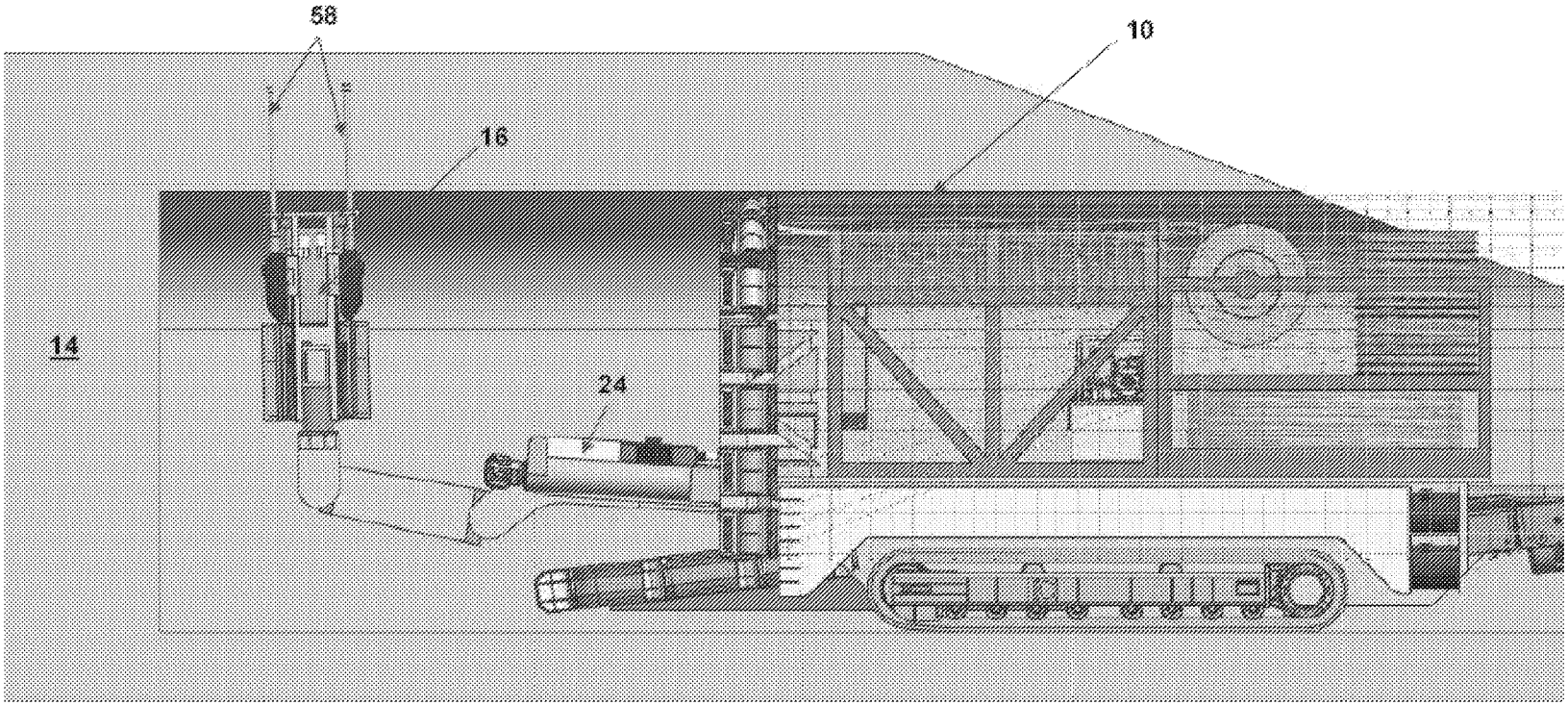
FIG. 12 shows a side view of the machine drilling holes in the tunnel roof for roof anchors.
Figure 13:
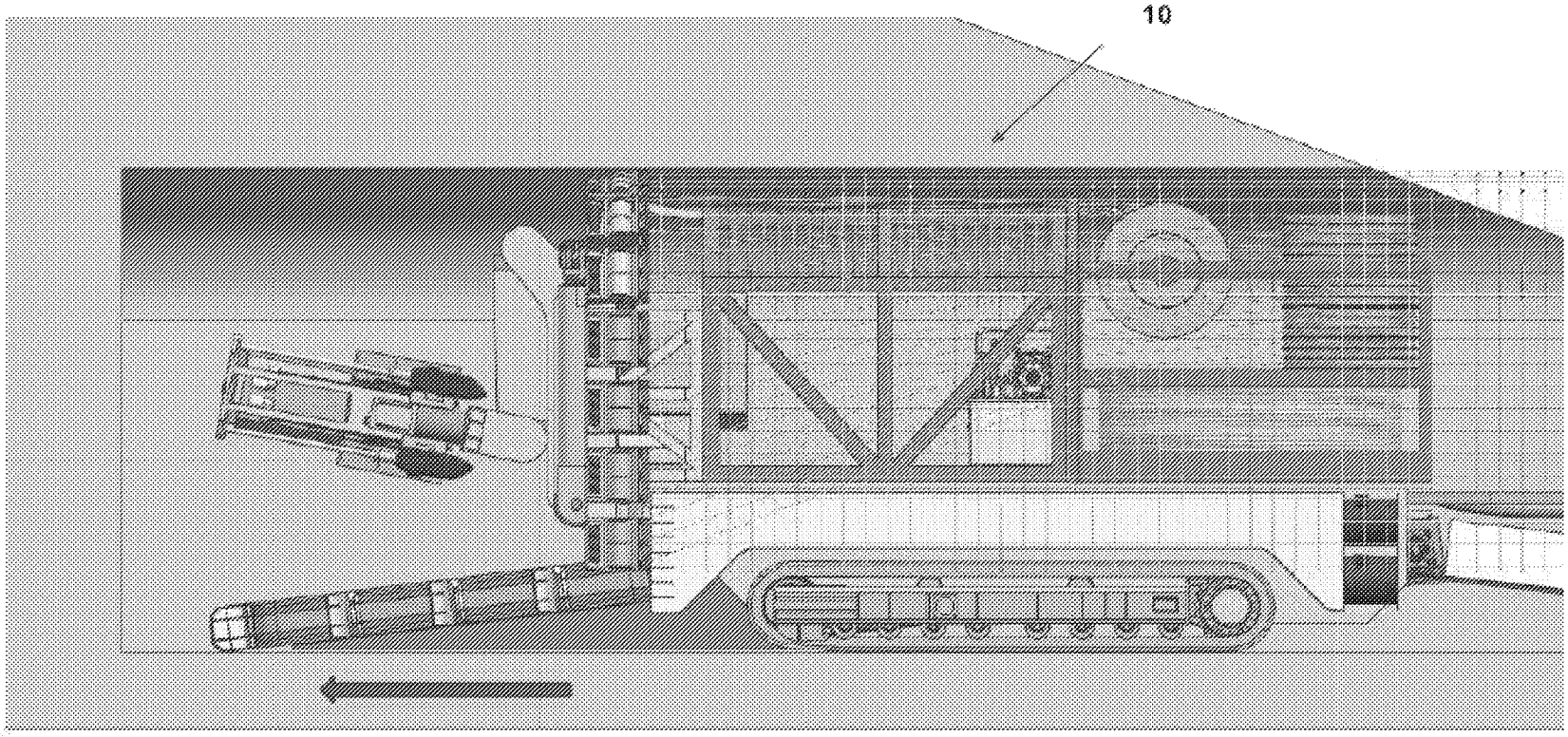
FIG. 13 shows a side view of the machine moving forward.
Figure 14:
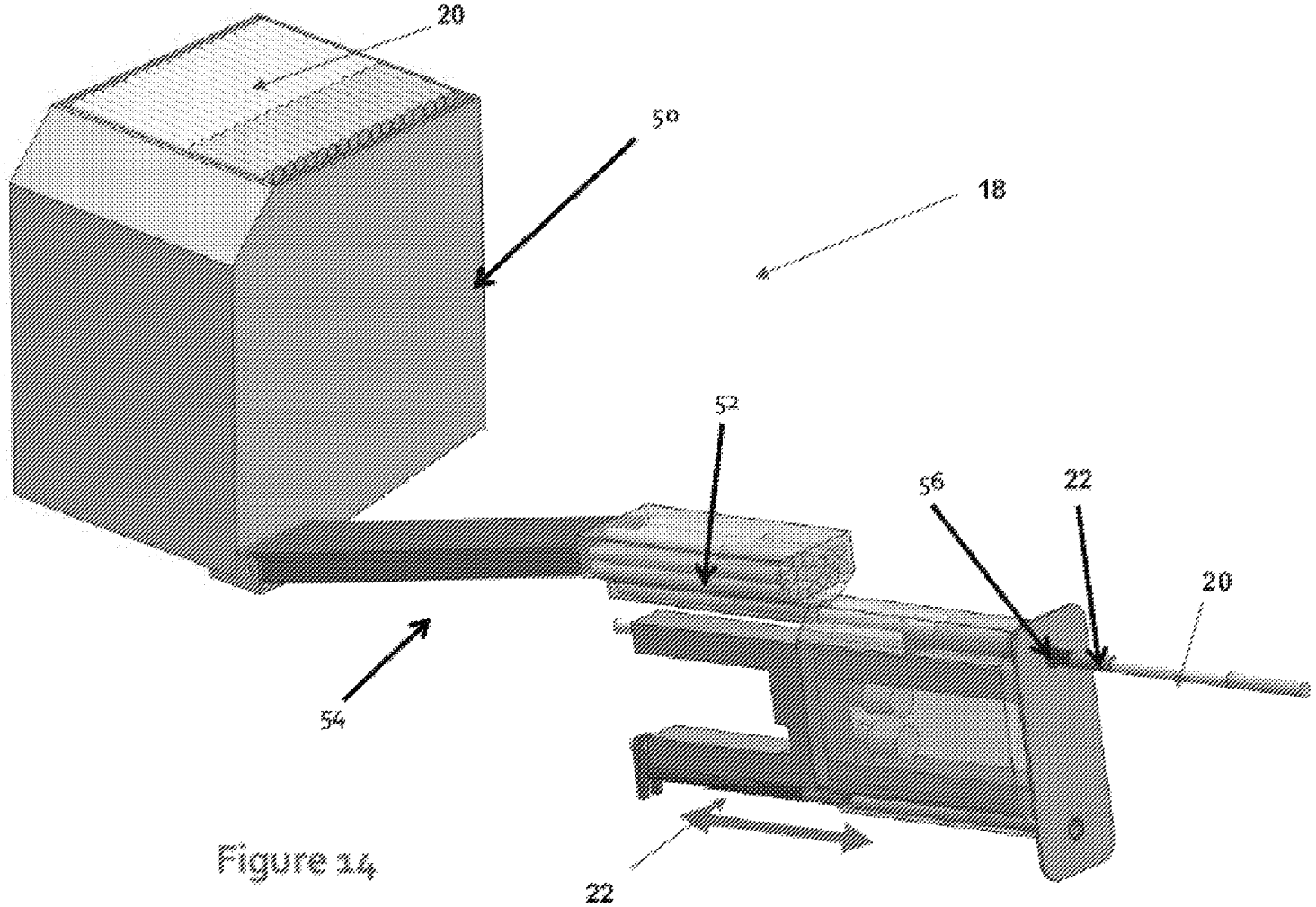
FIG. 14 shows a top perspective of the charge handling and loading assembly.
Figure 15:
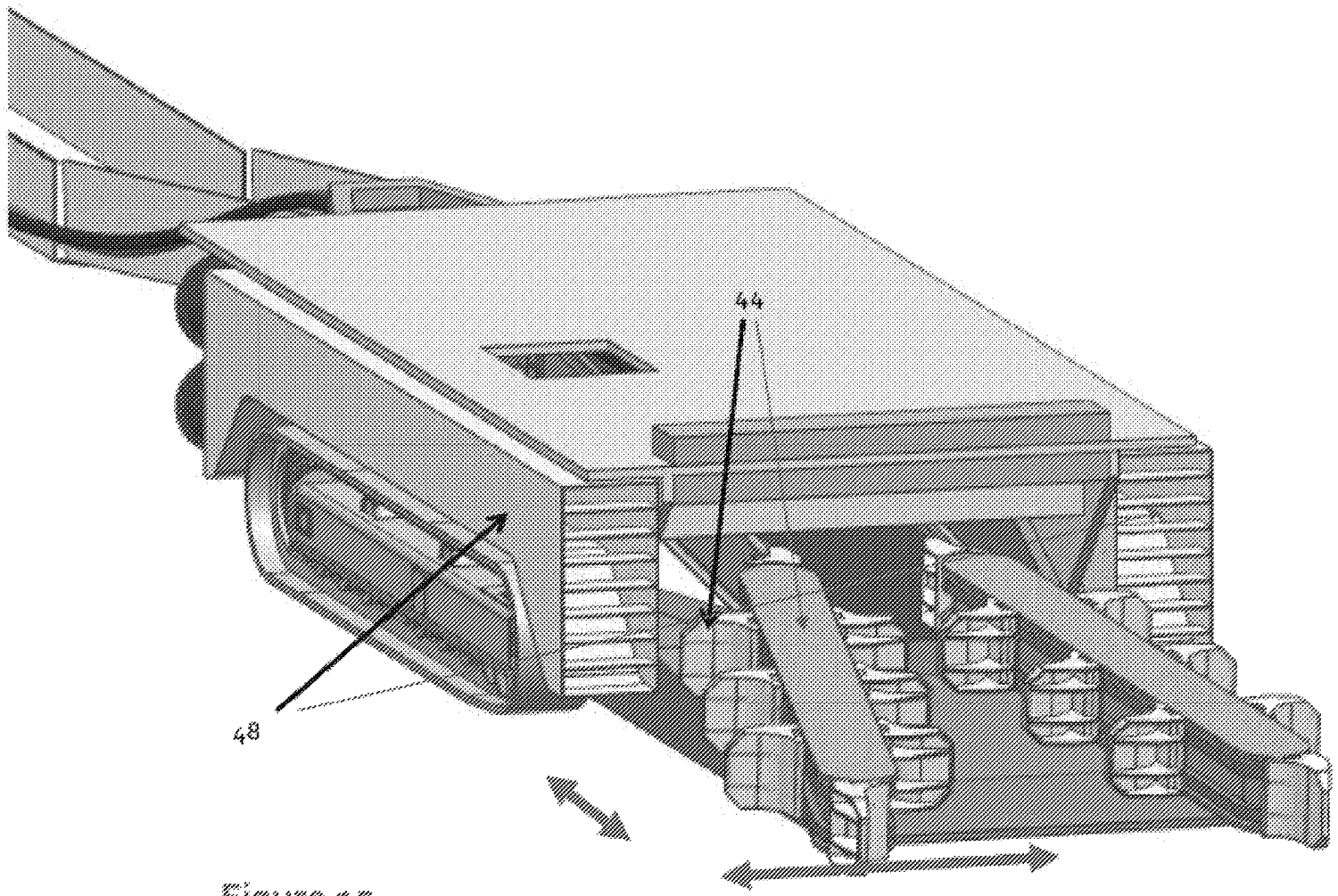
FIG. 15 shows a top perspective of the rock clearing means of the machine together with the dust suppression or removal system.
Figure 16:
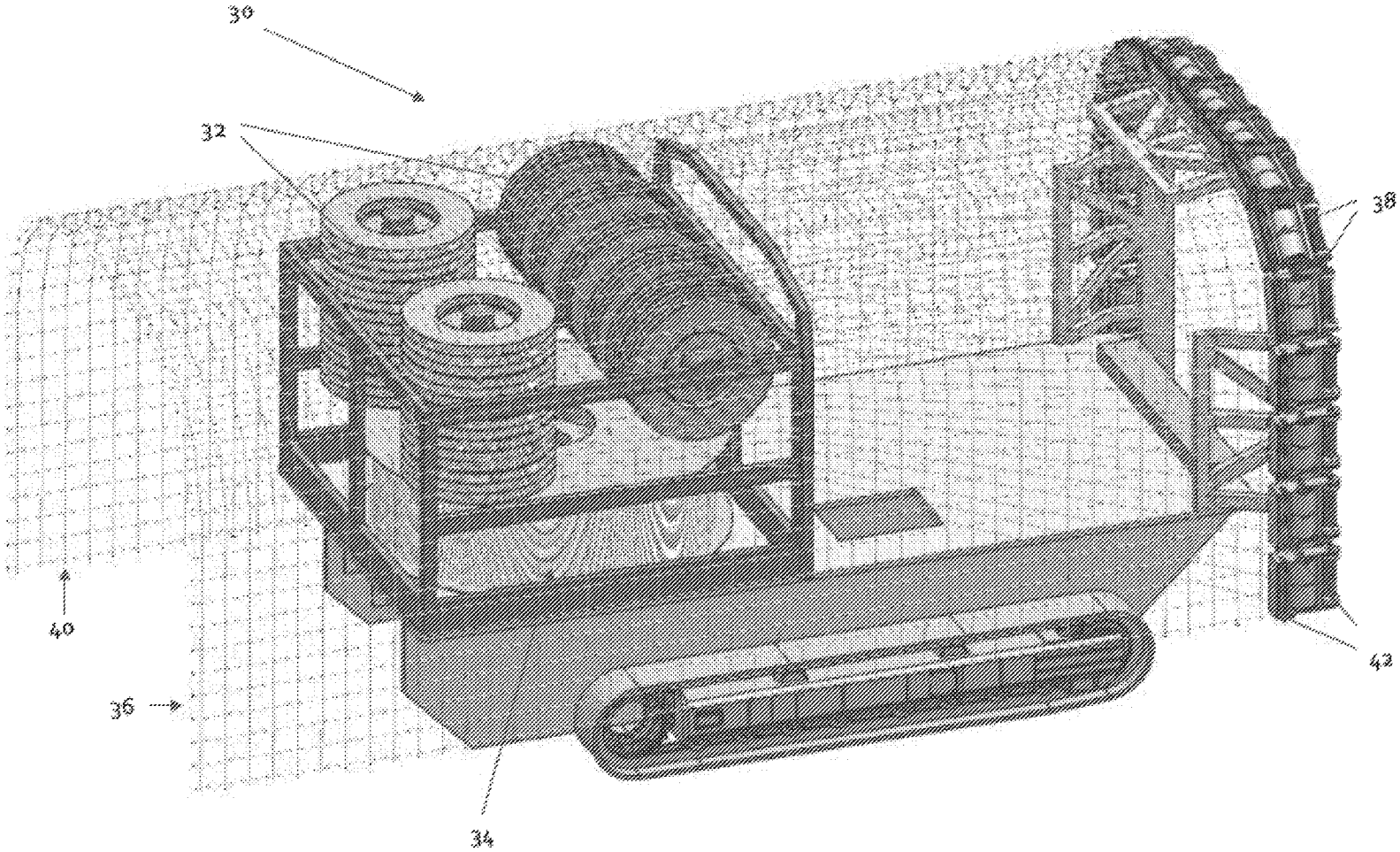
FIG. 16 shows a further top perspective of the wire mesh production assembly of the machine.
Figure 17:
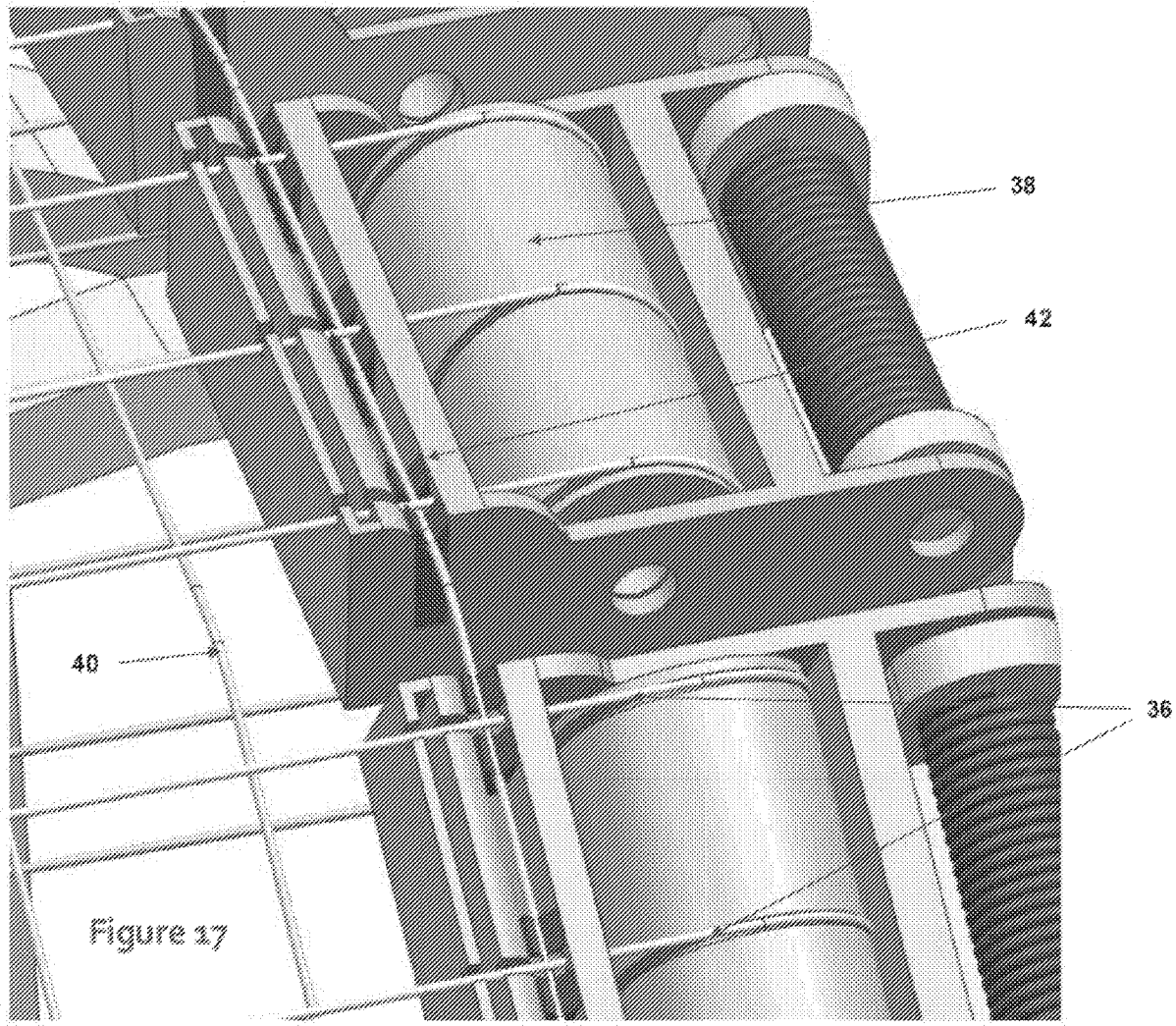
FIG. 17 shows a top perspective detail of part of the wire mesh production assembly of the machine.
Figure 18:
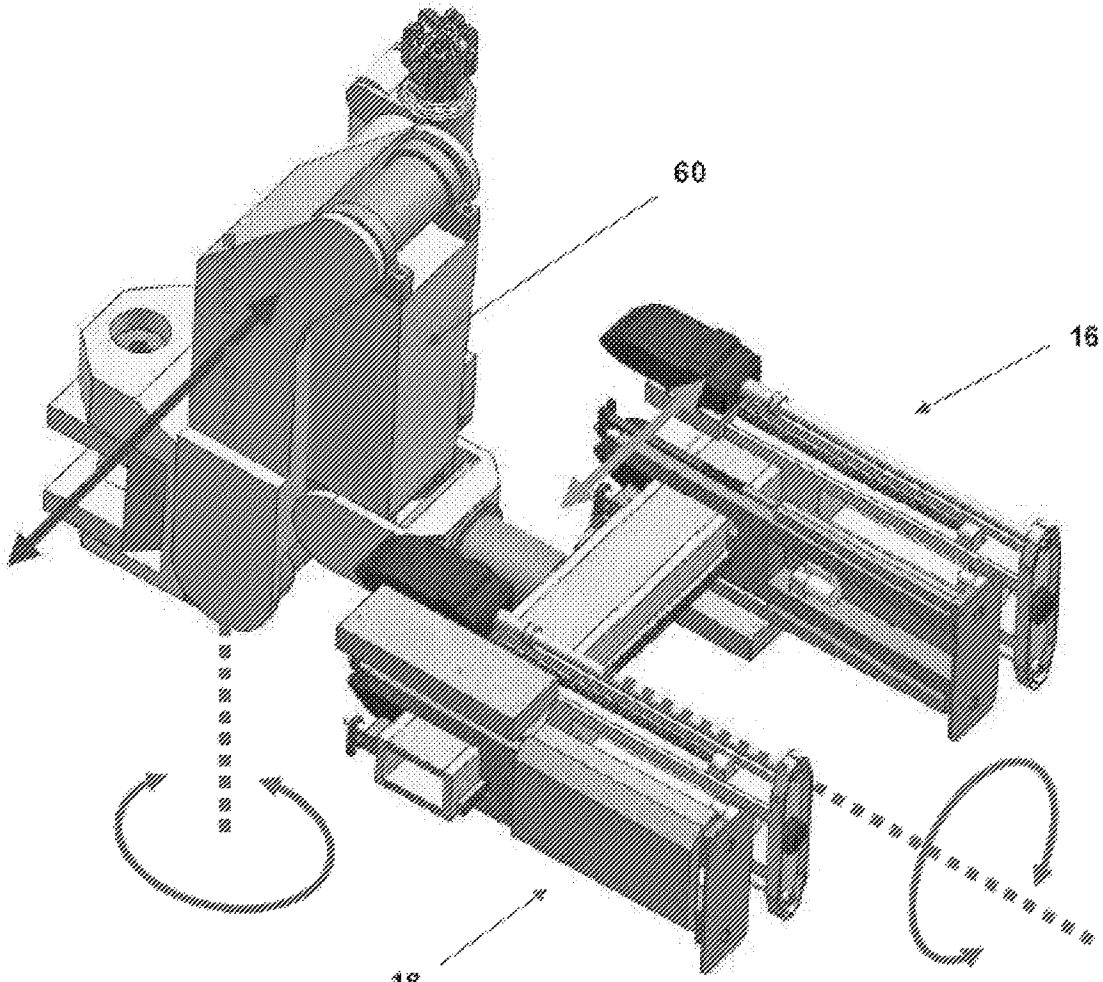
FIG. 18 shows a top perspective of part of the drilling and charging systems of the machine.

With reference to the drawings, the machine for tunnelling in rock is generally indicated by reference numeral 10. The machine 10 includes a pilot drill assembly 12 for drilling a pilot hole of 300 mm into and generally perpendicular into a rock face 14 and a blast hole drill assembly 16 for drilling a series of blasting holes around the pilot hole or previous blast hole. The diameter of the blast holes are typically between 75 and 100 mm The machine 10 further includes a charge handling and loading assembly 18 for loading the first series of holes with propellant charges 20 and integral therewith an ignitor system (not shown) for igniting the charges. Together with the pilot drill assembly 12, the machine is provided with a rock pick 24 for clearing and picking the floor, roof or walls to provide clear access for the machine into the tunnel. The machine 10 also includes a rock clearing means 26 for removing the blast rock from the blast face, which clearing means is located underneath a mobility assembly 28 for moving the machine forward. The machine 10 also includes a remotely situated control console (not shown) provided with control means for controlling the pilot drill assembly 12, blast hole drill assembly 16, charge handling and loading assembly 18, ignitor system, rock clearing means 26, mobility assembly 28 and the rock pick 24. The machine 10 also includes a mesh production assembly 30 for producing a wire mesh lining for progressively lining the walls and roof of the tunnel, in use. The mesh production assembly 30, includes a set of longitudinal wire spindles 32 and a lateral wire spindle 34. The longitudinal wires 36 are fed out and over forming wheels 38 arranged along the shape of the tunnel. The lateral wires 40 are drawn transverse and underneath the longitudinal wires 36 and urged and welded to the underside of the longitudinal wires by means of a set of welding rams 42.

The rock clearing means 26 includes a lower and forward extending pair of bucket type conveyors 44 arranged on arms in a V-formation for drawing in any rocks on the floor of the tunnel in front of the machine 10. The conveyors 44 may pivot in a horizontal plane allowing each to sweep in a lateral arc. The conveyors 44 are configured to have a forward and backward movement. The rock clearing means 26 further includes a conveyor belt 46 to convey the rocks underneath the machine 10 and onto a further conveyor system or chute to move the rock out of the tunnel.

The machine 10 is also be provided with a dust suppression system 48, typically a suction means for sucking in dusty air and smoke through a filter system.

The charge handling and loading assembly 18 includes a main charge storage container 50 for storage of rock breaking cartridges or charges 20 and a secondary loader magazine 52 for housing the number of cartridges 20 required for a blasting cycle. A charge conveyor 54 connects the main charge storage container 50 with the loader magazine 52. Reciprocal rams 56 transfer one cartridge at a time from underneath the magazine into a drilled hole. The reciprocal rams 56 are spaced the same distance as the drills 58 of the drilling assembly 16.

The igniter 22 of the igniter system is located at the end of each reciprocal ram 56, which ignites the charge 20 as it is inserted at the required depth. The igniter system will be electric, mechanical or optical ignition. The ignition system can be a direct or a indirect ignition system.

The blast hole drill assembly 16 for drilling a series of blasting holes includes and is arranged on a hydraulic arm 60 configured to move in any one or more of a x, y or z axis. It further include two or more pairs of rock drills 58 arranged on a rotatable track 62, and the pairs of drills are movable along the track.

The pilot drill assembly 12 is arranged on its own hydraulic arm 64 configured to move in any one or more of a x, y or z axis. The pilot drill assembly arm also carries the rock pick 24 for clearing and picking the floor, roof or walls.

Figure 19:
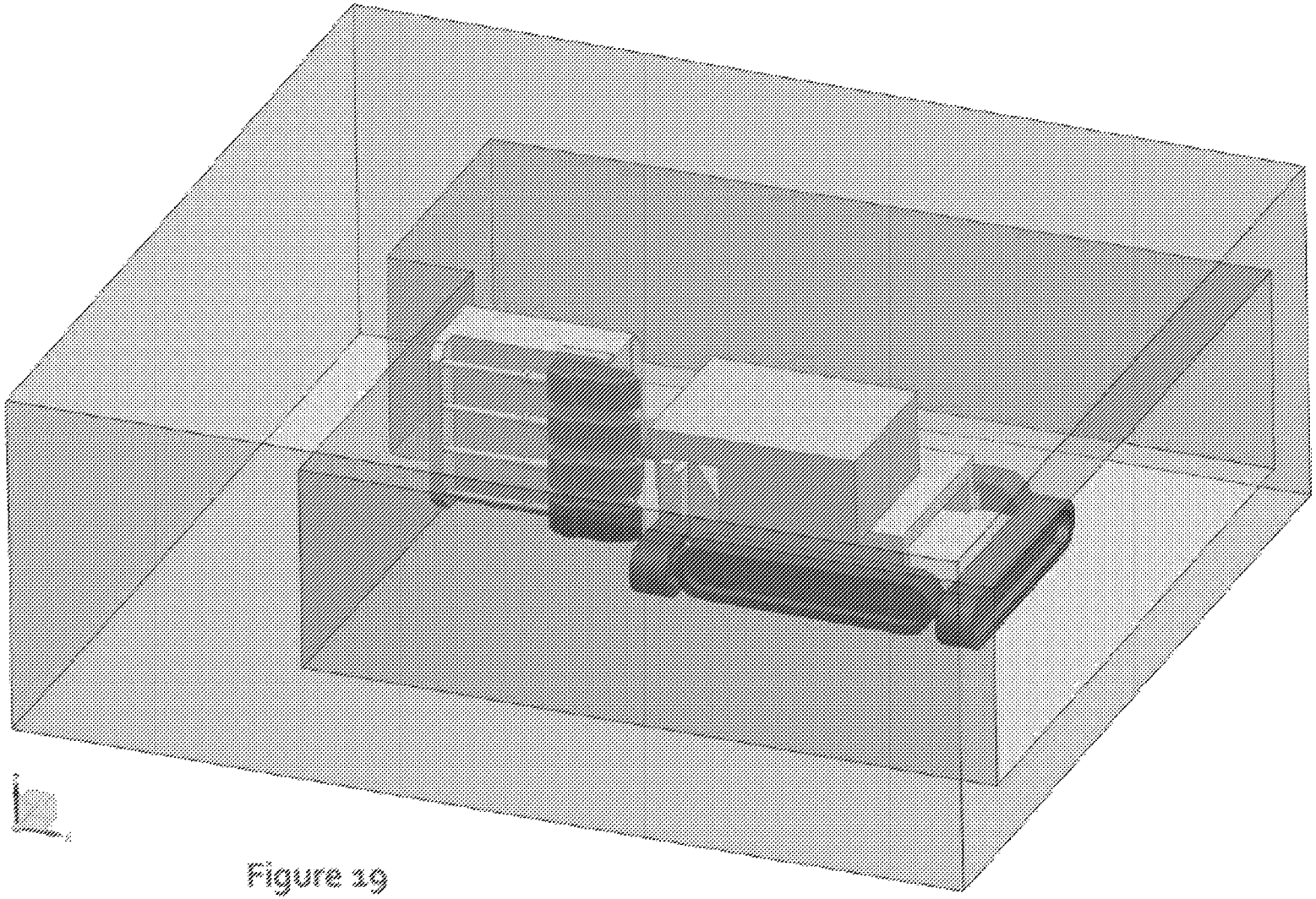
FIG. 19 shows a top perspective of a machine for tunnelling into rock adapted for stope mining.

The mobility assembly 28 for moving the machine forward and backward may comprise a set of continuous belt tracks 66. In the case of a stope mining machine (FIG. 19), the mobility assembly 28 may also include a set of transverse tracks 68, which is configured to be lifted, when not in use.

Gas analysing sensors will monitor the rock face for traces of methane gas on a regular bases. The machine will be programed to take the necessary safety actions when methane gasses are detected.

It shall be understood that the examples are provided for illustrating the invention further and to assist a person skilled in the art with understanding the invention and are not meant to be construed as unduly limiting the reasonable scope of the invention.

The invention claimed is:

1. A machine for tunneling in rock, which machine includes:

a pilot drill assembly for drilling a series of interfering parallel holes or a pilot hole into and generally perpendicular into a rock face;

a blast hole drill assembly for drilling a series of blasting holes around the pilot hole or previous blast hole;

a charge handling and loading assembly for loading the first series of holes with propellant charges;

an ignitor system for igniting the charges;

a rock clearing means for removing blast rock from a blast face;

a rock pick for clearing and picking a floor, roof or walls to provide access for the machine into a tunnel;

a mobility assembly for moving the machine forward;

a control console provided with control means for controlling the pilot drill assembly, blast hole drill assembly, charge handling and loading assembly, ignitor system, rock clearing means, and the rock pick;

a mesh production assembly for producing a wire mesh lining for progressively lining the walls and roof of the tunnel, wherein the mesh production assembly includes a set of longitudinal wire spindles and a set of lateral wire spindles or spindle and wherein the longitudinal wires are fed out and over forming wheels arranged along the shape of the tunnel and the lateral wires are drawn by means of directional guides and feeding wheels transverse and underneath the longitudinal wires and urged and welded to the underside of the longitudinal wires by means of a set of welding rams.

2. The rock tunneling machine as claimed in claim 1, wherein the control console is remote and further includes:

a measuring system for measuring gas concentrations;

a system to dilute gas concentration;

a rock stress measure system; and a recording system for reporting the measurements to the mining plan.

3. The rock tunneling machine as claimed in claim 1, wherein the rock clearing means includes a lower and forward extending pair of bucket type conveyors arranged on arms in a V-formation for drawing in any rocks on the floor of the tunnel in front of the machine.

4. The rock tunneling machine as claimed in claim 3, wherein the arms pivot in a horizontal plane allowing each to sweep in a lateral arc and the bucket type conveyors are configured to have a forward and backward movement.

5. The rock tunneling machine as claimed in claim 1, wherein the charge handling and loading assembly includes a main charge storage container for storage of rock breaking cartridges and a secondary loader magazine for housing the number of cartridges required for a blasting cycle, and a charge conveyor connects the main charge storage container with the loader magazine and reciprocal ram transfers one cartridge at a time from underneath the magazine into a drilled hole.

6. The rock tunneling machine as claimed in claim 5, wherein an igniter of the igniter system is located at the end of the reciprocal ram, which ignites the charge as it is inserted at the required depth.

7. The rock tunneling machine as claimed in claim 1, wherein the blast hole drill assembly for drilling a series of blasting holes includes and be arranged on a hydraulic arm configured to move in any one or more of a x, y or z axis, and includes two or more pairs of rock drills arranged on a rotatable track, and the pairs of drills are movable along the track.

8. The rock tunneling machine as claimed in claim 1, wherein the pilot drill assembly is arranged on its own hydraulic arm configured to move in any one or more of a x, y or z axis.

9. The rock tunneling machine as claimed in claim 1, wherein the mobility assembly for moving the machine forward and backward comprises a set of continuous belt tracks and a set of transverse tracks, which is configured to be lifted, when not in use.

10. A machine for tunneling in rock, which machine includes:

a pilot drill assembly for drilling a series of interfering parallel holes or a pilot hole into and generally perpendicular into a rock face;

a blast hole drill assembly for drilling a series of blasting holes around the pilot hole or previous blast hole;

a charge handling and loading assembly for loading the first series of holes with propellant charges;

an ignitor system for igniting the charges;

a rock clearing means for removing blast rock from a blast face;

a rock pick for clearing and picking a floor, roof or walls to provide access for the machine into a tunnel;

a mobility assembly for moving the machine forward;

a control console provided with control means for controlling the pilot drill assembly, blast hole drill assembly, charge handling and loading assembly, ignitor system, rock clearing means, and the rock pick; and wherein the charge handling and loading assembly includes a main charge storage container for storage of rock breaking cartridges and a secondary loader magazine for housing the number of cartridges required for a blasting cycle, and a charge conveyor connects the main charge storage container with the loader magazine and reciprocal ram transfers one cartridge at a time from underneath the magazine into a drilled hole; and wherein an igniter of the igniter system is located at the end of the reciprocal ram, which ignites the charge as it is inserted at the required depth.

11. A rock tunneling machine as claimed in claim 10, which includes a mesh production assembly for producing a wire mesh lining for progressively lining the walls and roof of the tunnel.

12. A rock tunneling machine as claimed in claim 11, wherein the mesh production assembly includes wire on two longitudinal wire spindles and wire on a lateral wire spindle and wherein the longitudinal wires are fed out and over forming wheels arranged along the shape of the tunnel and the lateral wire is drawn by means of directional guides and feeding wheels transverse and underneath the longitudinal wires and urged and welded to the underside of the longitudinal wires by means of a welding ram.

* * * * *